United States Patent [19]

Gilli et al.

[11] 3,982,379

[45] Sept. 28, 1976

[54] STEAM-TYPE PEAK-POWER GENERATING SYSTEM

[75] Inventors: Paul Viktor Gilli, Graz; Georg Beckmann, Vienna, both of Austria

[73] Assignee: Siempelkamp Giesserei KG, Krefeld, Germany

[22] Filed: Aug. 14, 1975

[21] Appl. No.: 604,811

[30] Foreign Application Priority Data

Aug. 14, 1974 Austria ..... 6641/74

[52] U.S. Cl. ..... 60/659; 60/652; 60/677; 122/35

[51] Int. Cl.[2] ..... F01K 3/00

[58] Field of Search ..... 60/652, 659, 677

[56] References Cited

UNITED STATES PATENTS 1,897,815 2/1933 Osenberg ..... 60/659

*Primary Examiner*—Allen M. Ostrager

*Attorney, Agent, or Firm*—Karl F. Ross; Herbert Dubno

[57] ABSTRACT

A body of water is confined in a closed vessel and heated to above 100°C. This water is then drawn in a liquid state from this vessel and passed through a first expander where it is separated into steam and condensate. The steam from this first expander is used to drive the first stage of a load and the condensate is passed to another expander where it is again transformed into steam and condensate, the steam being used to drive the second stage of the load. Several such expanders are provided and the condensate from the last expander is fed to a low-pressure storage vessel. The high-pressure vessel is filled almost to the top with water during periods of low power consumption and the water is drawn off during peak-power periods. Superheaters may be provided in the outlet conduits of the expanders and the water at above 100°C may be fed directly into the lower-pressure expanders to maintain their operating efficiency.

17 Claims, 6 Drawing Figures

STEAM-TYPE PEAK-POWER GENERATING SYSTEM

This application is a division of copending application Ser. No. 281,341, filed Aug. 17, 1972, now patent number 3,920,643, which is a continuation of copending application Ser. No. 103,334, filed Dec. 31, 1970, and now abandoned, which is a continuation-in-part of copending application Ser. No. 657,085, filed July 31, 1967, and now abandoned.

FIELD OF THE INVENTION

The present invention relates to a steam system. More particularly this invention concerns a steam-type energy-storage system usable for peak-period energy generation.

BACKGROUND OF THE INVENTION

Steam systems are known which have gravity-type steam accumulators wherein the pressure and temperature both drop as steam is taken out. Displacement-type reservoirs are also known wherein the pressure is maintained almost constant by reintroduction of water into it through a pump so that only the temperature inside the vessel drops.

With both of these systems there is a considerable temperature change within the main energy-storing accumulator or vessel. The obvious result of this temperature change is considerable thermal expansion and contraction so that only a relatively limited service life of the unit is obtainable.

OBJECTS OF THE INVENTION

It is therefore an object of the present invention to provide an improved steam system.

Another object is the provision of an improved method of and apparatus for storing energy and generating power.

Yet another object is to provide a steam system and method of operating same which overcomes the above and other disadvantages.

SUMMARY OF THE INVENTION

These objects are attained according to the present invention in a steam system having a high-pressure reservoir, a low-pressure reservoir, a conduit connected between a lower region of the high-pressure reservoir and the low-pressure reservoir, at least one expansion-type steam generator having a steam outlet and mounted in the conduit, and a restriction in the conduit between this generator and the high-pressure reservoir. A steam-powered load is connected to the outlet of the steam generator so that heated water passes out of the high-pressure reservoir, is transformed into steam by the generator, and the energy in this steam is exploited by the load. Means is provided for heating the water confined in the high-pressure reservoir or vessel above 100°C.

According to other features of this invention, several such expansion-type steam generators are cascaded one behind the other with respective restrictions that each steam generator receives from the preceding generator and produces steam at lower pressure than the preceding generator, with the condensate from the lowest-pressure generator being fed to the low-pressure reservoir. It is possible to combine the functions of the lowest-pressure steam generator and the low-pressure reservoir.

According to still other features of this invention the heated water is used to superheat the steam coming from the steam generator. A multistage load can be used with the partially spent steam from the highest-pressure stage being combined with the steam from a lower-pressure generator and superheated before being fed to the lower-pressure stages of the load.

With the system according to the present invention it is possible to function with virtually constant pressure and temperature in the high-pressure reservoir. This results in a considerable increase in the service life of this important element of the system which typically in peak-power generators wears out rapidly. The generator is filled virtually completely during low-power consumption periods with water about 100°C and this water is then drawn off during the peak period. Drawing off the superheated water does not, however, appreciably lower the pressure within the vessel, nor does it lower the temperature.

According to the present invention superheaters may be provided downstream of the steam generator. These superheaters use the hot water coming from the high-pressure reservoir and considerably increase the energy of the steam used to drive the load.

It is also possible to maintain the temperature and pressure within the high-pressure reservoir at a very steady level by providing a reserve high-pressure reservoir whose liquid is passed through a superheater and then admitted into to the steam space at the top of the main high-pressure reservoir. A by-pass or shunt conduit with a valve a cross the superheater allows the fluid flow through this superheater to be varied and, therefore, determines the temperature at which the liquid from the reserve or secondary reservoir enters the main reservoir. This type of arrangement allows the main reservoir to be operated virtually full of liquid, with only 1% up to a maximum of 3% of its volume being taken up by vapor.

The arrangement according to the present invention does not circulate the liquid from the low-pressure vessel back to the high-pressure vessel during the peak period, thereby increasing the operating efficiency at this time. Also the elimination of a high-pressure circulating pump that must operate continuously cuts equipment cost.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
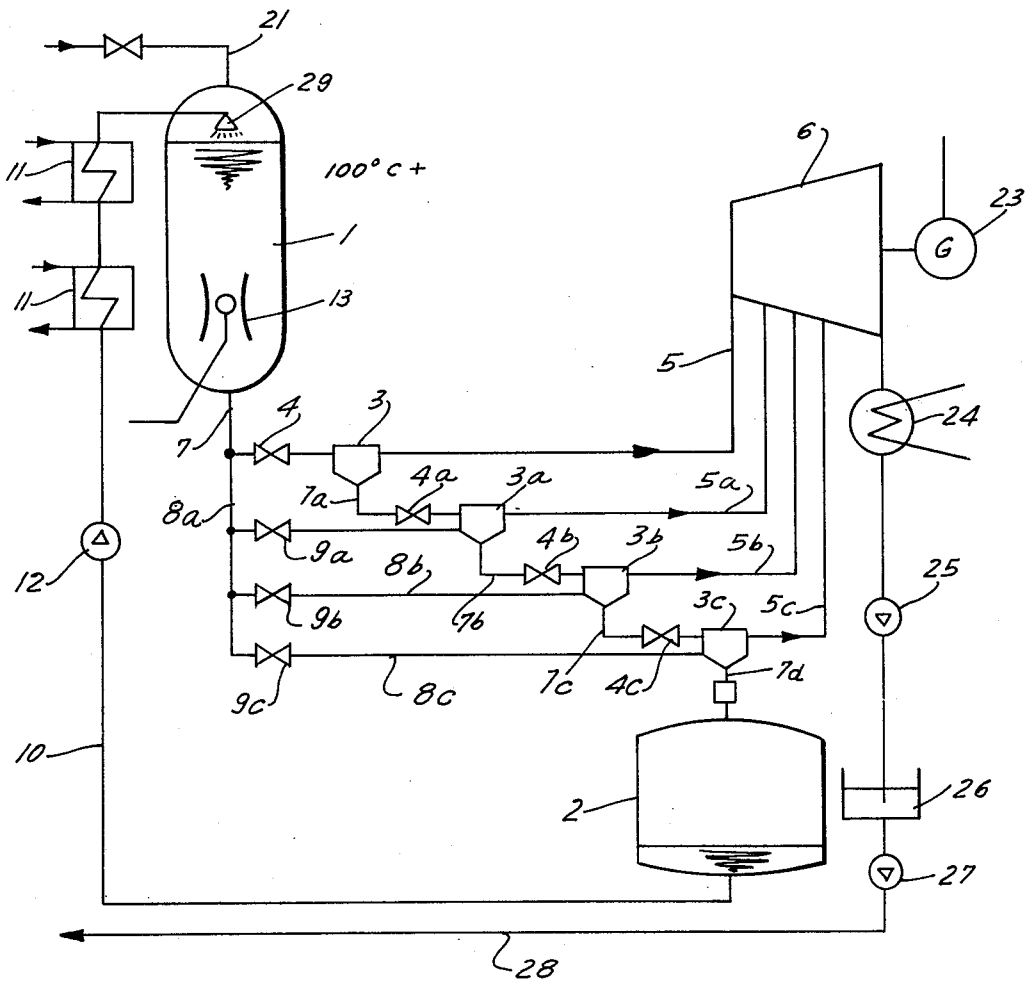
FIG. 1 is a schematic view of a system operating according to the method of the present invention.

As shown in FIG. 1 a high-pressure vessel or accumulator 1 is filled with a body of water that is at a temperature above 100°C. The water exits from this vessel 1 through a main discharge conduit 7, then passes through a variable restriction or expansion valve 4, and enters an expansion-type steam generator or expander 3. In this expander 3 the liquid drawn off from the vessel is transformed into steam that is fed via an outlet line or conduit 5 to the first stage of a turbine 6 that drives an electric-power generator 23. A condensate, still at above 100°C since the expander 3 operates at superatmospheric pressure, leaves the expander 3 via a discharge conduit 7*a* and passes through another restriction or expansion valve 5*a* and into another expander 3*a* cascaded in series with the evaporator 3. Steam from the expander 3*a* is fed via an outlet conduit 5*a* to a second stage of the turbine 6 and the condensate is fed via a discharge conduit 7*b* and a restriction 4*b* to another expander 3*b*. The steam from the expander 3*b* is fed via an outlet conduit 5*b* to the third stage of the turbine 6 and the condensate is fed via a discharge conduit 7*c* and restriction 4*c* to a fourth expander 3*c* whose steam is fed to the fourth stage of the turbine 6 via an outlet conduit 5*c* and whose condensate passes via a discharge conduit 7*c* into a low-pressure storage vessel 2.

During periods of low power consumption liquid is drawn out of the low-pressure reservoir 2 by a pump 12 via conduit 10 and passed through heat exchangers 11 so as to be reintroduced at above 100°C through a shower-type head 29 into the high-pressure vessel 1. Superheated steam may also be admitted to the vessel 1 via a conduit 21 opening at the very top of the vessel 1 or a sprayer 13 underneath the liquid level in the vessel 1.

The spent steam from the turbine 6 passes through a heat exchanger 24 which allows its heat to be exploited, as for instance in a home heating plant, then the spent steam principally in the form of liquid is passed by a pump 25 into a holding tank 26 from whence it can be drawn by a pump 27 and disposed of through a line 28.

A shunt conduit 8*a* and a restriction 9*a* may feed some of the heated water from the vessel 1 to the expander 3*a*, and similar conduits 8*b* and 8*c* and valves 9*b* and 9*c* may feed such liquid to the expanders 3*a*, 3*b*, and 3*c* are each operated at a lower pressure than the preceding expander 3, 3*a*, or 3*b*, respectively. The valves 9*a*, 9*b* and 9*c* are adjusted to insure maximum efficiency in each of the expanders 3*a*, 3*b* and 3*c*. In this manner virtually all of the work present in the hot water is exploited so that only relatively cool water at a temperature below 100°C is fed to the reservoir 2 which, therefore, can be made of very light construction.

Figure 2:
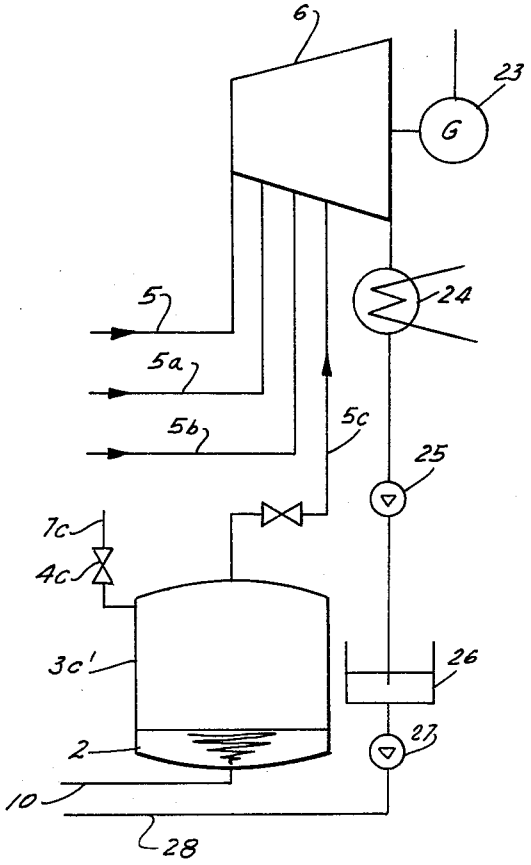
FIGS. 2 – 6 are schematic views of variations on the system of FIG. 1.

The upper portion 3*c*′ of the low-pressure reservoir 2 may be used as the last expander as shown in FIG. 2.

Figure 3:
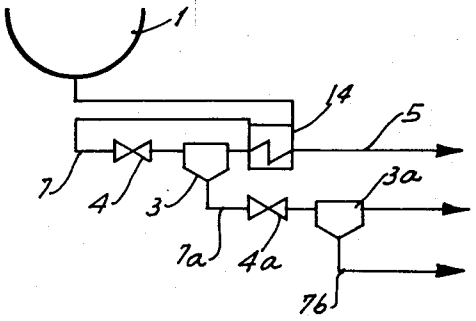
Figure 4:
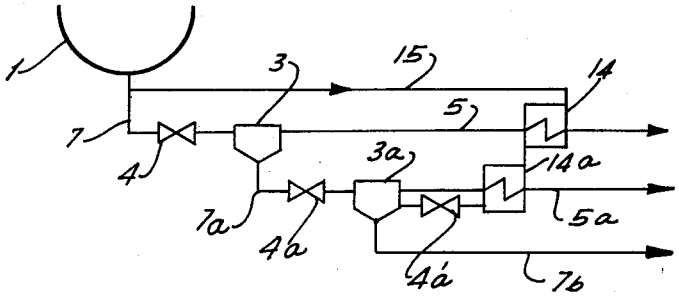

FIG. 3 shows how the heated water from the high-pressure vessel 1 may be passed through a superheater 14 provided in the outlet conduit 5 of the first expander 3. This arrangement ensures that the steam issuing from the expander 3 will be of very high temperature and will therefore be able to do a great deal of work. The arrangement of FIG. 4 is similar, with a conduit 15 extending from the discharge conduit 7 side of a superheater 14 whose outlet side is connected to another superheater 14*a* and the outlet conduit 5*a* of the expander 3*a*. The outlet side of this superheater 14*a* is connected through an expansion valve 4*a*′ to the superheater 3*a* so that this conduit 15 effectively replaces the conduit 8*a* and the valve 4*a*′ effectively replaces the valve 9*a*.

Figure 5:
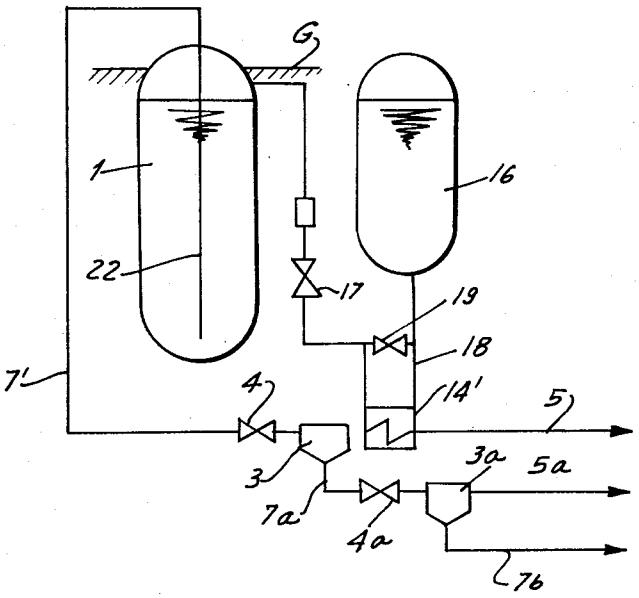

In the arrangement of FIG. 5 a secondary very high-pressure vessel 16 is provided having a discharge conduit 18 that feeds water in a liquid state at well above 100°C through a superheater 14′ provided in the outlet conduit 5 of the expander 3. The partially cooled liquid then passes through an expansion valve 17 and is admitted into the upper region of the main high-pressure vessel 1 so as to maintain the liquid level, pressure, and temperature therein substantially uniform. A by-pass valve 19 is provided shunting the superheater 14′ so as to allow the temperature of the liquid admitted at the top of the vessel 1 to be controlled within strict limits. FIG. 5 also shows how the vessel 1 is sunk in the ground G and an outlet conduit 7′ is provided which enters the top of the vessel 1 and has a section 22 extending down almost to the bottom thereof. Such a construction allows a very heavy-duty concrete-reinforced vessel 1 to be provided with no openings in its lower side to prevent a potential leak hazard.

Figure 6:
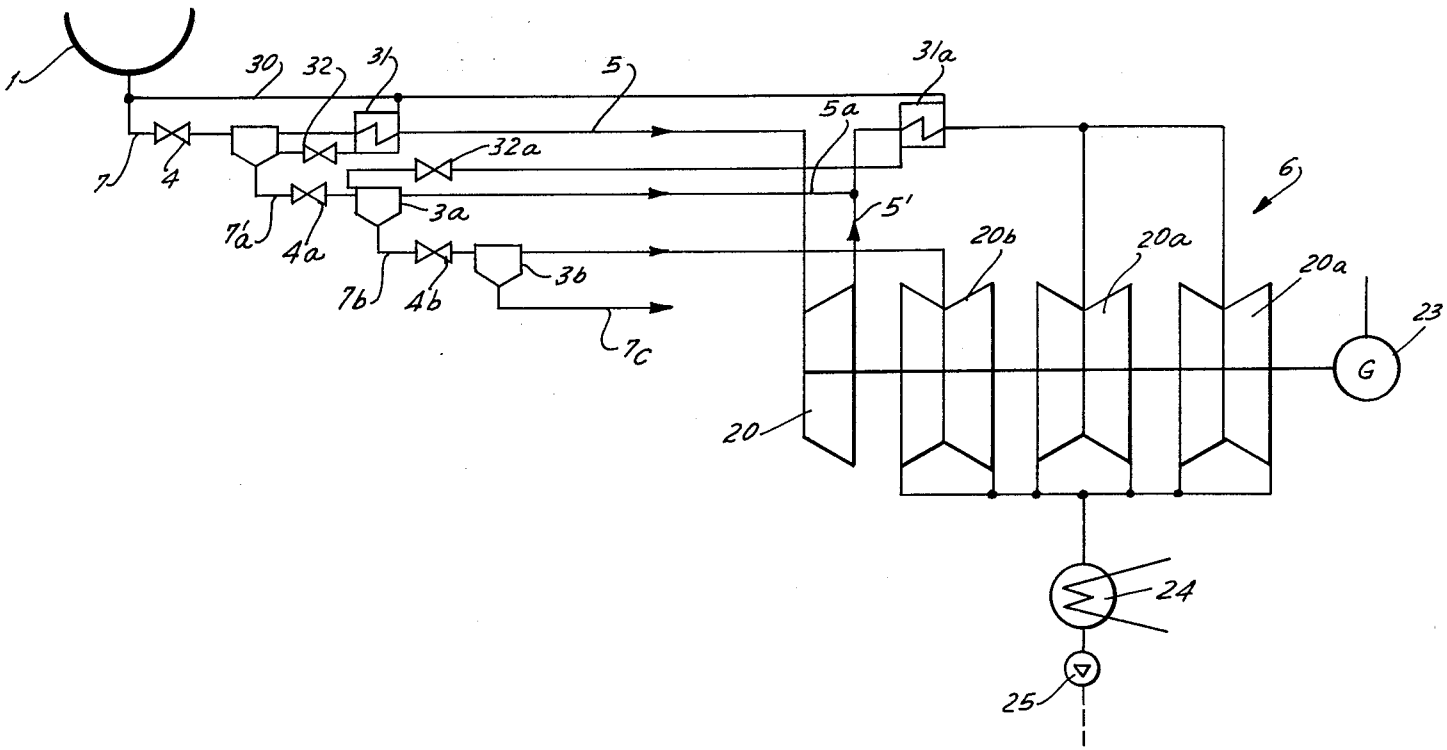

The arrangement of FIG. 6 shows a diverting line 30 extending from the discharge conduit 7 and connected to the inlet sides of a pair of superheaters 31 and 31*a*. The superheater 31 is provided in the outlet conduit 5 of the expander 3 and is connected to this expander 3 through a valve 32. The outlet conduit 5 is connected to the inlet side of the first stage 20 of the load 6 via a line 5′ that joins the outlet conduit 5*a* from the second expander 3*a*. These two lines 5*a* and 5′ pass through the other superheater 31*a* and thence go to the second stage 20*a* of the load 6. The outlet side of the second heat exchanger 31*a* is connected via a valve 32*a* to the respective expander 3*a*. The outlet conduit 5*b* from the third expander 3*b* is connected directly to the respective stage 20*b* of the load 6 and so on. Such a system allows virtually all of the energy in the hot water to be exploited.

We claim:

1. A steam system comprising:

a high-pressure generally closed reservoir;

means for heating a body of water in said high-pressure reservoir above 100°C;

a low-pressure generally closed reservoir;

a discharge conduit connected between a lower region of said high-pressure reservoir and said low-pressure reservoir for conducting heated water from the former toward the latter;

an expansion-type steam generator in said conduit and having a steam outlet;

a restriction in said discharge conduit between said generator and said high-pressure reservoir, whereby said heated water is at least partially converted into steam in said generator; and a steam-powered load connected to said outlet of said generator.

2. The system defined in claim 1, further comprising a second such steam generator and a second such restriction in said conduit connected in series with the first-mentioned generator and restriction, said second generator operating at lower pressure than said first generator.

3. The system defined in claim 2, further comprising a shunt conduit connected between said high-pressure reservoir and said second generator and valve means in said shunt conduit for regulating flow therethrough.

4. The system defined in claim 3 wherein said second generator is in said low-pressure reservoir.

5. The system defined in claim 1, further comprising a return conduit between said low-pressure reservoir and said high-pressure reservoir and a circulating pump for displacing liquid from the former to the latter.

6. The system defined in claim 5 wherein said means for heating includes a heat exchanger in said return conduit.

7. The system defined in claim 5 wherein said means for heating includes means for introducing superheated steam into said high-pressure reservoir.

8. The system defined in claim 1, further comprising a heat exchanger in said discharge conduit between said high-pressure reservoir and said restriction and an outlet conduit between said outlet and said load and passing through said heat exchanger.

9. The system defined in claim 1, further comprising a second such steam generator, a second such restriction in said discharge conduit connected in series with the first-mentioned generator and restriction, first and second outlet conduits connected between the outlets of said first and second generators said load, said first and second heat exchangers in said outlet conduits having inlet and outlet sides, the inlet side of said first exchanger being connected to said high-pressure reservoir for receiving superheated water therefrom and the outlet side of said first exchanger being connected to the inlet side of said second exchanger whose outlet side is connected to said second generator.

10. The system defined in claim 1, further comprising a superheating reservoir for containing a reserve body of heated water and having a conduit extending from itself below the level of said reserve body to said high-pressure reservoir, a restriction in said conduit of said superheating reservoir, a heat exchanger in said conduit of said superheating reservoir, and an outlet conduit extending through said heat exchanger from said outlet to said load.

11. The system defined in claim 10, further comprising means for varying the flow of water from said reserve body through said heat exchanger.

12. The system defined in claim 1, further comprising a second such steam generator and a second restriction in said conduit connected in series with the first-mentioned generator and restriction, said load having first and second stages with respective inlet and outlet sides, said system further comprising first and second outlet conduits between said first and second generators and the inlet sides of said first and second stages, and heat-exchanger means in said second outlet conduit and connected to said outlet side of said first stage for heating and mixing partially spent steam from said first stage with steam from said second generator prior to feeding of same to said second stage.

13. The system defined in claim 12, further comprising means for feeding water directly from said high-pressure reservoir through said heat-exchanger means.

14. A method of generating power comprising the steps of:

confining a body of water in a vessel;

heating the confined body of water above 100°C;

drawing off the heated water in a liquid state and expanding same at a location spaced from said vessel into steam and a condensate;

driving a power-generating load with said steam; and collecting said condensate at low pressure in a vessel.

15. The method defined in claim 14 wherein said confined body is heated principally during periods of low power consumption and said water is drawn off principally during periods of high power consumption.

16. The method defined in claim 15, further comprising the step of heating said steam using said heated water.

17. The method defined in claim 15, further comprising the steps of expanding said condensate to form a secondary condensate and secondary steam, feeding said secondary condensate to the low-pressure vessel, and driving said load with said secondary steam.

* * * * *